United States Patent [19]

Kato

[11] 4,372,783

[45] Feb. 8, 1983

[54] ELECTRICAL CONTACT COMPOSITION FOR A VACUUM TYPE CIRCUIT INTERRUPTER

[75] Inventor: Masaru Kato, Amagasaki, Japan

[73] Assignee: Mitsubishi Denki Kabushiki Kaisha, Tokyo, Japan

[21] Appl. No.: 172,484

[22] Filed: Jul. 25, 1980

[30] Foreign Application Priority Data

Jul. 27, 1979 [JP] Japan ..... 54-96468

[51] Int. Cl.[3] ..... B22F 3/00

[52] U.S. Cl. ..... 75/246; 75/247; 428/567; 200/264

[58] Field of Search ..... 75/228, 246, 247; 428/567; 200/264

[56] References Cited

U.S. PATENT DOCUMENTS

| | | | |
|---|---|---|---|
| 3,357,826 | 12/1967 | Honaker et al. | 75/222 |
| 3,818,163 | 6/1974 | Robinson | 200/264 |
| 3,957,453 | 5/1976 | Hässler et al. | 428/567 |
| 4,014,659 | 3/1977 | Hassler et al. | 428/567 |

*Primary Examiner*—Brooks H. Hunt

*Attorney, Agent, or Firm*—Sughrue, Mion, Zinn, Macpeak & Seas

[57] ABSTRACT

A vacuum type circuit interrupter contact comprises a principal phase material selected from the group consisting of copper and solid solutions of chromium copper, iron copper and cobalt copper, and a second phase material selected from the group consisting of chromium, iron and cobalt. The second phase material is dispersed into the principal phase material and has a particle diameter in the range of 74 μm to 250 μm. The contact can be formed by powder metallurgy, an infiltration process or a fusion process.

7 Claims, 3 Drawing Figures

ELECTRICAL CONTACT COMPOSITION FOR A VACUUM TYPE CIRCUIT INTERRUPTER

BACKGROUND OF THE INVENTION

This invention relates to an electrical contact composition for a vacuum type circuit interrupter used in a high current circuit with voltages above 10 KV.

The desirable characteristics of an electrical contact for a vacuum type circuit interrupter include the following:

(1) a low welding force,
(2) the ability to withstand high voltages,
(3) a large interrupting current capacity,
(4) a low chopping current, and
(5) minimal contact erosion.

In actual practice it is difficult for a contact to meet all of these requirements, and consequently some of the more essential requirements or characteristics are favored at the sacrifice of the others, in the sense of a trade off.

Conventional contacts are typically made by a fusion process or a powder metallurgy process, in both of which various kinds of second phase materials are added to copper (Cu), which is the principal phase material. The amount of second phase material added may be either greater or less than its solid solubility limit in copper, and it may have a higher or lower melting point than copper.

Conventional contacts may be roughly classified into two types depending on whether or not an added material will increase the overall contact brittleness, bismuth (Bi) being a typical material for increasing the brittleness of a copper based contact. Bismuth is only slightly soluble in copper, has a lower melting point than copper, and it itself relatively brittle. In a copper-bismuth (Cu-Bi) contact, the bismuth tends to segregate at the boundaries between the crystals of copper, and consequently such a contact has a low tensile strength. Such a contact has an excellent (low) welding force characteristic, however, and can thus be used in a high current circuit. Tellurium (Te), antimony (Sb) and certain other elements are also effective in increasing brittleness, but they are not as effective as bismuth for this purpose.

While contacts containing materials for increasing brittleness can be used in high current circuits, as mentioned above, they are mainly used in circuits ranging from 3 to 6 KV because of their relatively poor ability to withstand high voltages.

A typical prior art contact which does not contain materials for increasing brittleness is made by dispersing chromium (Cr) into a principal phase material of Cu (See the copending U.S. Patent Appln. Ser. No. 910,905 filed on May 26, 1978 by M. Kato) or a Cu-Cr solid solution. Such a Cu-Cr contact satisfies most of the above requirements, and may be used in circuits with voltages higher than 10 KV. This type of contact exhibits a large welding force, however, and consequently it cannot be used in a high current circuit.

Other high voltage contacts include iron (Fe) or cobalt (Co) dispersed into a principal phase material of Cu or a Cu-Fe solid solution, or into Cu or a Cu-Co solid solution, respectively. These types of contacts also do not contain any material for increasing brittleness, however, so they still have the defect of a large welding force characteristic.

Atomic ratios of these solid solutions as the first phase material are usually as follows. Atomic ratios of Cr: Cu, Fe: Cu, Co: Cu are less than 0.8, 4.5 5.5 (w%) respectively.

SUMMARY OF THE INVENTION

It is thus an object of this invention to provide a new and improved contact for a vacuum type circuit interrupter having an improved welding force characteristic, and the ability to accommodate high currents at voltages greater than 10 KV. This object is accomplished by providing a contact consisting essentially of a principal phase material selected from a group consisting of copper and solid solutions of chromium copper, iron copper, and cobalt copper into which a second phase material selected from a group consisting of chromium, iron, and cobalt is dispersed, wherein the particle diameter of said second phase material is in the range of 74 μm to 250 μm.

DETAILED DESCRIPTION OF THE PREFERRED EMBODIMENTS

Figure 1:
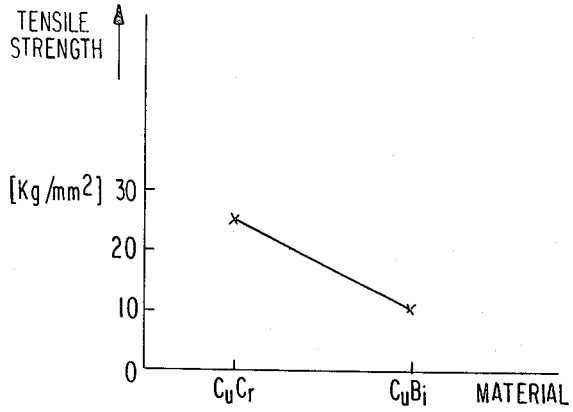
FIG. 1 is a graph showing tensile strength test results of Cu-Bi and Cu-Cr contacts.

The Cu-Cr contact tested in FIG. 1 was made by dispersing chromium into a principal phase of copper, with about 30% of the contact volume being occupied by chromium particles having a diameter of under 74 μm. FIG. 1 clearly shows that the tensile strength of a Cu-Cr contact is more than twice that of a Cu-Bi contact.

Because there are no known contacts for practical vacuum type circuit interrupters which have a low welding force with an attendant high current capacity at voltages above 10 KV, it is difficult to develop an effective vaccum type interrupter with a high interrupting capacity.

Initially, Cu-Bi contacts with their increased brittleness were investigated to determine if their ability to withstand voltages above 10 KV could be improved. Such improvement was found difficult, however, because of an unavoidable defect caused by a physical characteristic of bismuth. Specifically, since bismuth has a relatively low melting point of 271° C. and a relatively high vapor pressure on the order of $10^{-2}$ Torr at 1000° K., it unavoidably segregates at the crystal boundaries of copper. The bismuth in a Cu-Bi contact is vaporized in large quantities to a state of bismuth atoms or molecules at temperatures above 400° C., which are applied in the baking process essential to the production of vacuum type circuit interrupters. The vaporized bismuth adheres to the surfaces of the insulating vessel of the interrupter. Such vaporization and adherence is also caused by heat energy generated by the closing, conducting, or interrupting operations of a vacuum type circuit breaker, thereby reducing its voltage withstanding ability. Thus, as long as bismuth is used as a second phase material for contacts, a reduced voltage capacity is unavoidable.

Taking the above characteristics of Cu-Bi contacts into consideration, the present invention provides a contact having an improved welding force characteristic capable of handling high currents at voltages above 10 KV without using any material for increasing brittleness, such as bismuth. The contact of this invention is made by dispersing chromium, iron or cobalt particles with selected diameters ranging from 74 μm to 250 μm into the principal phase material selected from a group consisting of copper and solid solutions of chromium copper, iron copper and cobalt copper, and may be made by a fusion process or a powder metallurgy process.

The chromium, iron, or cobalt particles must be dispersed into the principal phase in great quantities, and a special heat treatment is therefore required to improve dispersion, and in the case of iron whose density is above the solid solubility limit, to prevent the formation of iron dentride.

To reduce the welding force of these vacuum interrupter contacts, previous efforts have concentrated on measuring the welding force of the loaded interrupter with the welded contact surfaces stuck together. Consequently, there has been a lack of investigation of the minute or small and instantaneous metallic composition of the contact base metal. To compensate for this deficiency, rupture dynamics principles and techniques were applied to the past research aimed at reducing the tensile strength of the contact base metal. It is clear from the results obtained that the reduction of the tensile strength will result in a reduction of the welding force.

According to rupture dynamics, the contacts may be defined as the compositions in which the uncountable number of particles of the hard second phase material selected from the granular group consisting of Cr, Fe, and Co are dispersed into the soft principal phase material selected from the group consisting of Cu-Cr, Cu-Fe and Cu-Co solid solutions and Cu. To reduce the tensile strength it is necessary to determine the volume ratio or the particle diameter of the second phase material, in addition to the other properties of the principal and second phase materials. Furthermore, according to a theorem of rupture dynamics, the tensile strength decreases with increasing volume ratios or particle diameters of the second phase material of the contacts because the stress is produced concentrically around the second phase material when the contacts are loaded.

As the result of such analysis, it was recognized that there are two conflicting or antagonistic factors concerning the particle diameter of the second phase material. Namely, there is the conventional conception that the voltage capacity of the contact depends upon the volume ratio or the particle diameter of the second phase material, that is, the smaller the particle diameter, the higher the voltage capacity, whereas the present inventor has found that the larger the particle diameter of the second phase material, the lower the tensile strength.

Thus, there is a definite antagonism between the voltage capacity and the tensile strength concerning the particle diameter of the second phase material. Generally, according to a theorem of dispersion strengthening, a small particle diameter of the second phase material contributes to an increased tensile strength. This means that it is necessary to keep the particle diameter of the second phase material above a fixed value in order to reduce the tensile strength.

In both the fusion and powder metallurgy processes of the prior art, the particle diameter of the second phase material has a considerably wide distribution. In this distribution, if the particle diameter of the second phase material decreases below a fixed value, the effect of the second phase material having a particle diameter close to the lower limit in increasing tensile strength and the effect of the second phase material having a particle diameter close to the upper limit or an intermediate value in decreasing it cancel each other, and the former generally overrides the latter.

In recognition of and in an effort to resolve and overcome this conflict, various tests were conducted in an attempt to determine the volume ratio or the particle diameter of the second phase material to provide a contact having a voltage capacity above 10 KV and yet a low welding force for a large current capacity. The results of such tests are shown in FIGS. 2 and 3.

Figure 2:
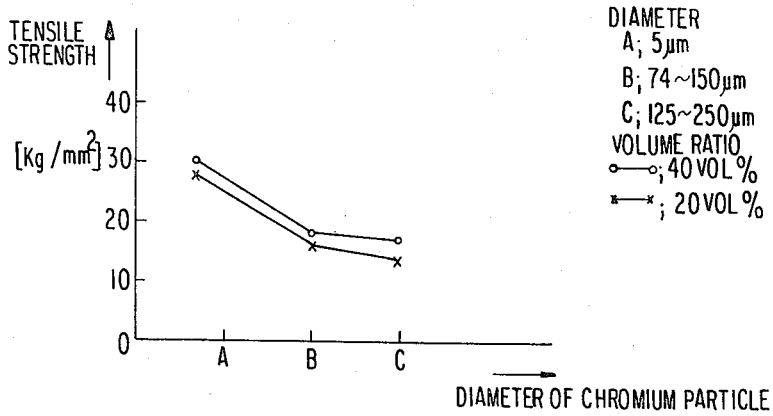
FIG. 2 is a graph showing tensile strength test results of various Cu-Cr contacts according to the present invention.

As easily seen from FIG. 2, the tensile strength of a Cu-Cr contact including Cr as the second phase material surprisingly depends largely on the particle diameter of the Cr and only slightly on the volume ratio. Further, it is clear from FIG. 2 that the tensile strength of a Cu-Cr contact can be decreased to almost the same low level of a Cu-Bi contact by proper selection of the particle size range.

Figure 3:
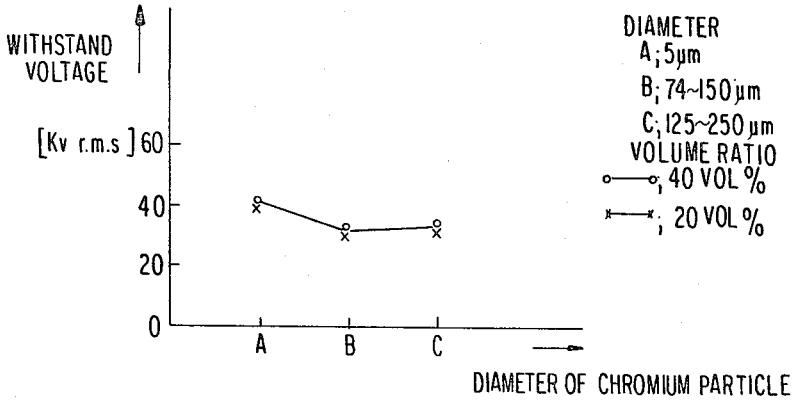
FIG. 3 is a graph showing the voltage capacity characteristics of the Cu-Cr contacts used in FIG. 2.

Further, it may be clearly seen from FIG. 3 that as long as the particle diameter of the second phase material ranges from 74 μm to 250 μm and the volume ratio ranges from 20% to 40%, Cu-Cr contacts can have both a low tensile strength and attendantly high current capacity comparable to that of Cu-Bi contacts, and the high voltage capacity of conventional Cu-Cr contacts.

Three types of vacuum interrupters having Cu-Cr, Cu-Fe and Cu-Co contacts with particle diameters and volume ratios selected from the ranges stated above were manufactured, and tests were made of their welding force, voltage capacity, interrupting current, chopping current, and contact erosion characteristics in circuits above 10 KV. Each interrupter satisfied all requirements. The three different types had substantially the same welding force, voltage capacity and chopping current characteristics, with the Cu-Cr contact being superior in large interrupting current and contact erosion characteristics compared to the others.

I claim:

1. In an electrical contact for a vacuum type circuit interrupter comprising a principal phase material selected from a group consisting of chromium copper solid solution, iron copper solid solution, cobalt copper solid solution, and copper; and a second phase material selected from a group consisting of chromium, iron and cobalt and dispersed into the principal phase material, the improvement characterized by: the particle diameter of the second phase material being in a range of from 74 μm to 250 μm.

2. A contact according to claim 1, wherein the principal phase material is copper or chromium copper solid solution, and the second phase material is chromium.

3. A contact according to claim 1, wherein the volume ratio of the second phase material to the total contact material is in a range of from 20 to 40%.

4. A contact according to claims 1, 2 or 3, wherein the contact is formed by a powder metallurgy process.

5. A contact according to claims 1, 2 or 3 wherein the contact is formed by an infiltration process.

6. A contact according to claims 1, 2 or 3 wherein the contact is formed by a fusion process.

7. A contact according to claim 3, wherein the principal phase material is copper or chromium copper solid solution, and the second phase material is chromium.

* * * * *